US010519944B2

(12) United States Patent
Taguchi

(10) Patent No.: US 10,519,944 B2
(45) Date of Patent: Dec. 31, 2019

(54) VARIABLE DISPLACEMENT COMPRESSOR

(71) Applicant: SANDEN HOLDINGS CORPORATION, Isesaki-shi (JP)

(72) Inventor: Yukihiko Taguchi, Isesaki (JP)

(73) Assignee: SANDEN HOLDINGS CORPORATION, Gunma (JP)

( * ) Notice: Subject to any disclaimer, the term of this patent is extended or adjusted under 35 U.S.C. 154(b) by 392 days.

(21) Appl. No.: 15/532,894

(22) PCT Filed: Dec. 1, 2015

(86) PCT No.: PCT/JP2015/083694
§ 371 (c)(1),
(2) Date: Jun. 2, 2017

(87) PCT Pub. No.: WO2016/088737
PCT Pub. Date: Jun. 9, 2016

(65) Prior Publication Data

US 2017/0363074 A1 Dec. 21, 2017

(30) Foreign Application Priority Data

Dec. 2, 2014 (JP) ..... 2014-244253

(51) Int. Cl.
*F04B 27/18* (2006.01)
*F04B 27/10* (2006.01)
(Continued)

(52) U.S. Cl.
CPC ..... *F04B 27/1804* (2013.01); *F04B 27/0804* (2013.01); *F04B 27/1081* (2013.01);
(Continued)

(58) Field of Classification Search
CPC ..... F04B 27/1804; F04B 2027/1809; F04B 2027/1813; F04B 2027/1827;
(Continued)

(56) References Cited

U.S. PATENT DOCUMENTS 8,714,938 B2 * 5/2014 Okuda ..... F04B 27/1081 417/222.1
2003/0202885 A1 10/2003 Taguchi
(Continued)

FOREIGN PATENT DOCUMENTS

| | | |
|---|---|---|
| CN | 1333430 | 1/2002 |
| JP | 2004-3468 | 1/2004 |
| JP | 2010-106677 | 5/2010 |
| JP | 2011-185138 | 9/2011 |

OTHER PUBLICATIONS

Office Action dated Jul. 18, 2018 issued in the corresponding Chinese Patent Application No. 201580065376.3.
Office Action dated Aug. 7, 2018 which issued in the corresponding Japanese Patent Application No. 2014-244253.

*Primary Examiner* — Dominick L Plakkoottam
(74) *Attorney, Agent, or Firm* — Cozen O'Connor

(57) ABSTRACT

A variable displacement compressor which prevents leakage of a refrigerant flowing directly into a suction chamber without passing via a crank chamber at a time of a minimum discharge displacement operation, thus making it possible to prevent an increase of a minimum discharge displacement by increasing a refrigerant pressure in the crank chamber, and in addition, making it possible to prevent insufficient lubrication of sliding portions and the like in the crank chamber.

7 Claims, 6 Drawing Sheets

(51) Int. Cl.
*F04B 39/08* (2006.01)
*B60H 1/32* (2006.01)
*F04B 27/08* (2006.01)

(52) U.S. Cl.
CPC ..... *F04B 39/08* (2013.01); *B60H 1/3223* (2013.01); *F04B 2027/1813* (2013.01); *F04B 2027/1822* (2013.01); *F04B 2027/1827* (2013.01); *F04B 2027/1845* (2013.01); *F04B 2027/1854* (2013.01); *F04B 2027/1859* (2013.01); *F04B 2027/1868* (2013.01); *F04B 2027/1872* (2013.01)

(58) Field of Classification Search
CPC ..... F04B 2027/1831; F04B 2027/1836; F04B 2027/1845; F04B 2027/1854; F04B 2027/1859; F04B 2027/1868; F04B 27/1081; F04B 2027/1818; F04B 2027/1822; F04B 2027/185; F04B 2027/1863; F04B 2027/1872; F04B 27/08; F04B 27/0804; F04B 39/08; F04B 39/10
USPC ..... 417/222.1, 222.2, 270
See application file for complete search history.

(56) References Cited

U.S. PATENT DOCUMENTS

2004/0258536 A1* 12/2004 Ota ..... F04B 27/1804 417/222.2
2008/0138213 A1* 6/2008 Umemura ..... F04B 27/1804 417/222.2
2010/0104454 A1 4/2010 Ota et al.
2011/0091334 A1* 4/2011 Taguchi ..... F04B 27/1804 417/222.1
2011/0182753 A1* 7/2011 Taguchi ..... F04B 27/1804 417/222.1
2011/0214564 A1* 9/2011 Okuda ..... F04B 27/1081 91/505
2013/0272859 A1* 10/2013 Taguchi ..... F04B 27/1804 415/182.1

* cited by examiner

VARIABLE DISPLACEMENT COMPRESSOR

RELATED APPLICATIONS

This is a U.S. National Phase Application under 35 USC 371 of International Application PCT/JP2015/083694 filed on Dec. 1, 2015.

This application claims the priority of Japanese application no. 2014-244253 filed Dec. 2, 2014, the entire content of which is hereby incorporated by reference.

TECHNICAL FIELD

The present invention relates to a variable displacement compressor for use in a vehicle air conditioning system, and particularly, relates to a variable displacement compressor that controls a pressure of a refrigerant, which is directed from a discharge chamber side to a crank chamber, by a control valve, and varies a discharge displacement by varying an inclination angle of a swash plate in the crank chamber.

BACKGROUND ART

As this type of variable displacement compressor, for example, there are those described in Patent Documents 1 and 2. In the variable displacement compressor disclosed in each of Patent Documents 1 and 2, a second control valve, which opens and closes in conjunction with opening and closing operations of an electromagnetic first control valve interposed in a pressure supply passage that supplies a compressed refrigerant in a discharge chamber to a crank chamber, is interposed in a pressure release passage that releases a pressure of the refrigerant directed from the crank chamber to a suction chamber side, and in addition, there is provided a check valve that blocks a flow of the refrigerant directed from the crank chamber side to the first control valve side. In the variable displacement compressor with such a configuration, when energization to the first control valve is stopped, and the first control valve opens fully, then the second control valve closes due to a pressure rise in a pressure supply passage region located downstream of the first control valve, and reduces an opening degree of the pressure release passage. At this time, an inclination angle of a swash plate of the crank chamber becomes minimum, and an operation state with a minimum discharge displacement is obtained. Moreover, when the compressor is activated to thereby energize the first control valve and close the first control valve, then due to a pressure decrease of such a pressure supply region located downstream of the first control valve, the second control valve opens to increase the opening degree of the pressure release passage. According to such a configuration, when the compressor is stopped, the compressor is promptly shifted to such a minimum discharge displacement operation state, and when such a compressor in which a liquid refrigerant is present in the crank chamber for a long time is activated after being stopped for a long time, the opening degree of the pressure release passage is maximized, thus making it possible to rapidly release the refrigerant pressure in the crank chamber to the suction chamber side. In this way, a time until a discharge displacement of the compressor is increased is shortened, whereby operation efficiency of the variable displacement compressor is enhanced.

REFERENCE DOCUMENT LIST

Patent Documents

Patent Document 1: Japanese Patent Application Laid-open Publication No. 2010-106677

Patent Document 2: Japanese Patent Application Laid-open Publication No. 2011-185138

SUMMARY OF THE INVENTION

Problems to be Solved by the Invention

However, in the variable displacement compressor described in each of Patent Documents 1 and 2, in order to relieve the refrigerant pressure in the pressure supply passage region between the check valve and the first control valve to the suction chamber side when the first control valve is closed, a pressure relief passage that causes the suction chamber and the pressure supply passage region between the first control valve and the check valve to communicate with each other is provided, and the pressure supply passage region and the suction chamber always communicate with each other via this pressure relief passage. According to such a configuration, when the compressor does the minimum discharge displacement operation, a part of the compressed refrigerant supplied from the discharge chamber side to the crank chamber flows directly into the suction chamber from the pressure relief passage without passing via the crank chamber. Therefore, it is apprehended that the pressure in the crank chamber may not be able to be increased sufficiently at the time of such a minimum discharge displacement operation, resulting in that the inclination angle of the swash plate may not become the minimum to increase the minimum discharge displacement. Moreover, since the refrigerant also contains lubricating oil, it is apprehended that an amount of the lubricating oil flowing into the crank chamber at a time of such a minimum discharge displacement operation may decrease, resulting in that insufficient lubrication of sliding portions and the like in the crank chamber may be brought about.

The present invention has been made in view of the above-described problems. It is an object of the present invention to provide a variable displacement compressor, which prevents leakage of the refrigerant flowing directly into the suction chamber from the pressure relief passage without passing via the crank chamber at the time of the minimum discharge displacement operation, thus making it possible to prevent the increase of the minimum discharge displacement by increasing the refrigerant pressure in the crank chamber, and in addition, making it possible to prevent the insufficient lubrication of the sliding portions and the like in the crank chamber.

Means for Solving the Problems

This and other objects are attained in accordance with one aspect of the present invention directed to a variable displacement compressor, which includes: a first control valve that controls an opening degree of a pressure supply passage that causes a discharge chamber and a crank chamber to communicate with each other; a check valve that is interposed in the pressure supply passage downstream of the first control valve, and blocks a flow of a refrigerant from the crank chamber side to the first control valve side; a second control valve that controls an opening degree of a pressure release passage that releases a refrigerant pressure in the crank chamber to a suction chamber side in conjunction with the first control valve, receives a refrigerant pressure in a pressure supply passage region downstream of the first control valve and decreases the opening degree of the pressure release passage when the first control valve opens, and receives a refrigerant pressure on the crank chamber side and increases the opening degree of the pressure release passage when the first control valve closes; and a pressure relief passage that relieves a refrigerant pressure in a pressure supply passage region between the first control valve and the check valve to the suction chamber side, in which the variable displacement compressor controls an opening degree of the first control valve to control the refrigerant pressure in the crank chamber, and changes an inclination angle of a swash plate in the crank chamber to vary a discharge displacement, wherein opening and closing means capable of opening and closing the pressure relief passage is provided.

Effects of the Invention

According to the variable displacement compressor of the present invention, there is provided the opening and closing means capable of opening and closing the pressure relief passage that relieves the refrigerant pressure in the pressure supply passage region between the first control valve and the check valve to the suction chamber side, and accordingly, the pressure relief passage can be opened and closed when necessary. Hence, the pressure relief passage can be closed by the opening and closing means at the time of the minimum discharge displacement operation of the variable displacement compressor, and most of the compressed refrigerant delivered from the discharge chamber can be supplied to the crank chamber. In this way, the pressure in the crank chamber can be sufficiently increased at the time of the minimum discharge displacement operation, the load on the compressor at the time of the minimum discharge displacement operation is reduced, and the operation efficiency of the compressor can be enhanced. Moreover, the amount of lubricating oil in the crank chamber can also be sufficiently ensured, and the insufficient lubrication of the sliding portions in an inside of the compressor can be prevented.

BRIEF DESCRIPTION OF THE DRAWINGS

FIG. 4A is a cross-sectional view illustrating an open state of the pressure relief passage; and FIG. 4B is a cross-sectional view illustrating a blocked state of the pressure relief passage.

FIG. 5A is a cross-sectional view illustrating an open state of the check valve; and FIG. 5B is a cross-sectional view illustrating a closed state of the check valve.

FIG. 6A is a cross-sectional view illustrating a closed state of the second control valve; and FIG. 6B is a cross-sectional view illustrating an open state of the second control valve.

MODE FOR CARRYING OUT THE INVENTION

Hereinafter, embodiments of the present invention will be described with reference to the drawings.

Figure 1:
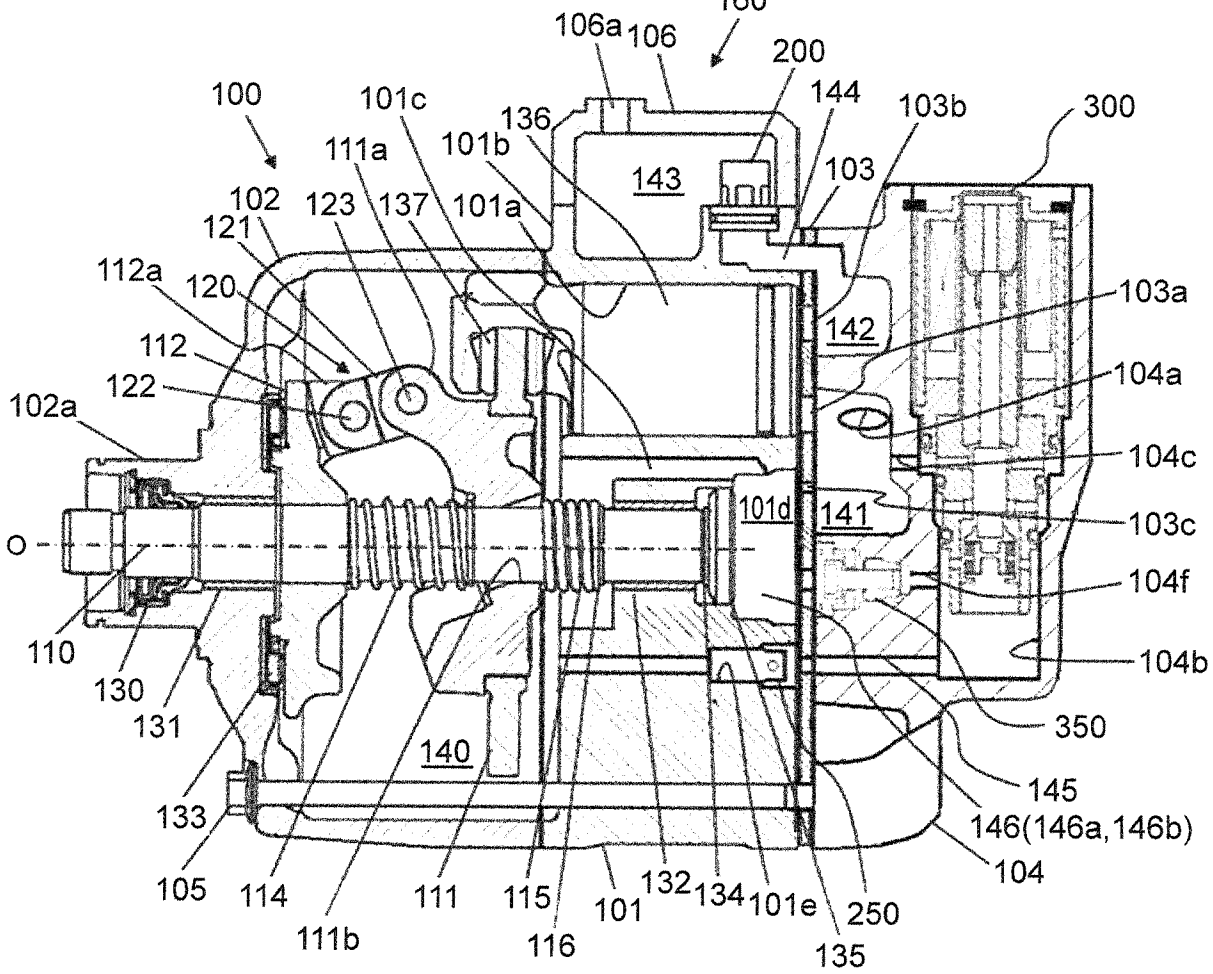
FIG. 1 is a cross-sectional view illustrating an embodiment of a variable displacement compressor of the present invention.

FIG. 1 illustrates a schematic configuration of a variable displacement compressor in an embodiment of the present invention, and is an example of a clutchless variable displacement compressor for use in a vehicle air conditioning system.

In FIG. 1, this variable displacement compressor 100 includes: a cylinder block 101 in which a plurality of cylinder bores 101*a* are formed; a front housing 102 provided on one end of the cylinder block 101; and a cylinder head 104 provided on other end of the cylinder block 101 via a valve plate 103 and the like.

A drive shaft 110 is provided so as to traverse a crank chamber 140 formed of the cylinder block 101 and the front housing 102. A swash plate 111 is disposed around an axially intermediate portion of the drive shaft 110. The swash plate 111 is coupled to a rotor 112, which is fixed to the drive shaft 110, via a link mechanism 120, and is supported by the drive shaft 110 so that an inclination angle thereof can be changeable.

The link mechanism 120 includes: a first arm 112*a* protruded from the rotor 112; a second arm 111*a* protruded from the swash plate 111; and a link arm 121, in which one end is rotatably coupled to the first arm 112*a* via a first coupling pin 122, and other end is rotatably coupled to the second arm 111*a* via a second coupling pin 123.

A through hole 111*b* of the swash plate 111 is formed into such a shape that the swash plate 111 is capable of tilting within a range between a maximum inclination angle (θmax) and a minimum inclination angle (θmin), and in the through hole 111*b*, a minimum inclination angle restricting portion that abuts against the drive shaft 110 is formed. When an inclination angle of the swash plate 111 when the swash plate 111 is perpendicular to the drive shaft 110 is 0°, the minimum inclination angle restricting portion of the through hole 111*b* is formed so that the swash plate 111 can be inclined up to approximately 0°. Moreover, the maximum inclination angle of the swash plate 111 is regulated in such a manner that the swash plate 111 abuts against the rotor 112.

An inclination angle decreasing spring 114, which is made of a compression spring that urges the swash plate 111 toward the minimum inclination angle, is mounted around the drive shaft 110 between the rotor 112 and the swash plate 111. Moreover, around the drive shaft 110 between the swash plate 111 and a spring support member 116 provided on the drive shaft 110, there is mounted an inclination angle increasing spring 115 made of a compression spring that urges the swash plate 111 in a direction of increasing the inclination angle of the swash plate 111 to a predetermined angle smaller than the maximum inclination angle. Urging force of the inclination angle increasing spring 115 at the minimum inclination angle is set larger than urging force of the inclination angle decreasing spring 114. Accordingly, when the drive shaft 110 does not rotate, the swash plate 111 is positioned at a predetermined inclination angle at which resultant force of the urging force of the inclination angle decreasing spring 114 and the urging force of the inclination angle increasing spring 115 becomes zero.

One end of the drive shaft 110 penetrates an inside of a boss portion 102*a* of the front housing 102, extends to an outside of the front housing 102, and is coupled to a power transmission device (not illustrated). A shaft sealing device 130 is inserted between the drive shaft 110 and the boss portion 102*a*, and shields the crank chamber 140 and an external space from each other.

A coupled body of the drive shaft 110 and the rotor 112 is supported by bearings 131 and 132 in a radial direction, is supported by a bearing 133 and a thrust plate 134 in a thrust direction, and power from an external drive source (an engine of the vehicle), is transmitted to a power transmission device, and the drive shaft 110 rotates in synchronization with the power transmission device. A clearance between the drive shaft 110 and the thrust plate 134 is adjusted to a predetermined clearance by an adjustment screw 135.

A piston 136 is disposed in the cylinder bore 101*a*, an outer peripheral portion of the swash plate 111 is housed in an inner space of an end portion of the piston 136, which protrudes toward the crank chamber 140 of the piston 136, and the swash plate 111 is linked with the piston 136 via a pair of shoes 137. Hence, the piston 136 reciprocates in the cylinder bore 101*a* by rotation of the swash plate 111.

In the cylinder head 104, a suction chamber 141 in a center portion thereof and a discharge chamber 142 that annularly surrounds this suction chamber 141 are defined and formed. The suction chamber 141 communicates with the cylinder bore 101*a* via a suction hole 103*a* provided in the valve plate 103 and via a suction valve (not illustrated) formed in a suction valve forming plate 150 (illustrated in FIG. 5), and the discharge chamber 142 communicates with the cylinder bore 101*a* via a discharge hole 103*b* provided in the valve plate 103 and via a discharge valve (not illustrated) formed in a discharge valve forming plate 151 (illustrated in FIG. 5).

The front housing 102, a center gasket (not illustrated), the cylinder block 101, a cylinder gasket 152 (illustrated in FIG. 5), the suction valve forming plate 150, the valve plate 103, the discharge valve forming plate 151, a head gasket 153 (illustrated in FIG. 5) and the cylinder head 104 are sequentially connected to one another, and are fastened by a plurality of through bolts 105, whereby a compressor housing is formed.

A muffler 160 that reduces noise and vibration, which are caused by pressure pulsation of the refrigerant, is provided on an upper portion of the cylinder block 101. The muffler 160 is formed in such a manner that a lid member 106 is fastened to a formed wall 101*b*, which is defined and formed on the upper portion of the cylinder block 101, via a sealing member (not illustrated) by bolts (not illustrated).

In a connection portion between a muffler space 143 and a communication passage 144 that is formed across the cylinder head 104 and the cylinder block 101 and communicates with the discharge chamber 142, a check valve 200 is disposed, which prevents a reverse flow of refrigerant gas from a discharge-side refrigerant circuit to the discharge chamber 142. The check valve 200 operates in response to a pressure difference between the communication passage 144 on an upstream side and the muffler space 143 on a downstream side, shuts off the communication passage 144 when the pressure difference is smaller than a predetermined value, and opens the communication passage 144 when the pressure difference is larger than the predetermined value. The discharge chamber 142 is connected to the discharge-side refrigerant circuit of such a vehicle air conditioning system via a discharge passage composed of the communication passage 144, the check valve 200, the muffler space 143 and a discharge port 106*a*.

In the cylinder head 104, a suction passage composed of a suction port (not illustrated) and a communication passage 104*a* is linearly formed so as to cross a part of the discharge chamber 142 from an outside of the cylinder head 104 toward the suction chamber 141, and the suction chamber 141 is connected to a suction-side refrigerant circuit of the vehicle air conditioning system via the suction passage.

Moreover, in the cylinder head 104, a first control valve 300 is provided by being housed in a housing hole 104*b* formed in a radial direction of the cylinder head 104. The first control valve 300 is interposed in a pressure supply passage 145 that causes the discharge chamber 142 and the crank chamber 140 to communicate with each other. In response to a pressure in the suction chamber 141, which is introduced via a communication passage 104*c*, and in response to electromagnetic force generated based on an external signal, the first control valve 300 controls an opening degree of the pressure supply passage 145, and controls a supply amount of the compressed refrigerant gas from the discharge chamber 142 to the crank chamber 140. In the pressure supply passage 145 located downstream of the first control valve 300, a check valve 250 is disposed, which blocks a reverse flow of the refrigerant from the crank chamber 140 side to the first control valve 300 side. The above-described check valve 250 operates in response to a pressure difference between an upstream side and downstream side thereof in the pressure supply passage 145. When the pressure in such an upstream pressure supply passage 145 is higher than the pressure in such a downstream pressure supply passage 145, the check valve 250 opens to open the pressure supply passage 145, whereby the refrigerant is introduced into the crank chamber 140. Meanwhile, when the pressure in the upstream pressure supply passage 145 is lower than the pressure in the downstream pressure supply passage 145, the check valve 250 closes to shut off the pressure supply passage 145, whereby the reverse flow of the refrigerant from the crank chamber 140 side to the first control valve 300 side is blocked. Note that details of the first control valve 300 and the check valve 250 will be described later.

The refrigerant in the crank chamber 140 flows into the suction chamber 141 via a pressure release passage 146 composed of: a first pressure release passage 146*a* that passes via a communication passage 101*c* and a space portion 101*d*, which are formed in the cylinder block 101, and via a fixed throttle 103*c* formed in the valve plate 103; and a second pressure release passage 146*b* in which a second control valve 350 is interposed, the second pressure release passage 146*b* starting from the space portion 101*d* and having a larger flow passage cross-sectional area than the fixed throttle 103*c*. The above-described second control valve 350 controls an opening degree of the second pressure release passage 146*b* in conjunction with the first control valve 300. When the first control valve 300 opens, the second control valve 350 receives a refrigerant pressure in a region of the pressure supply passage 145, which is located downstream of the first control valve 300, and reduces the opening degree of the second pressure release passage 146*b*. When the first control valve 300 is closed, the second control valve 350 receives a refrigerant pressure on the crank chamber 140 side, and increases the opening degree of the second pressure release passage 146*b*. Hence, in response to the opening and closing of the second control valve 350, there changes a flow passage cross-sectional area of the pressure release passage 146 composed of the first pressure release passage 146*a* and the second pressure release passage 146*b*. Note that details of the second control valve 350 will be described later.

Lubricating oil is sealed in an inside of the variable displacement compressor 100, and the inside of the variable displacement compressor 100 is lubricated by agitation of the lubricating oil, which accompanies the rotation of the drive shaft 110, and by movement of the lubricating oil, which accompanies the movement of the refrigerant gas.

Figure 2:
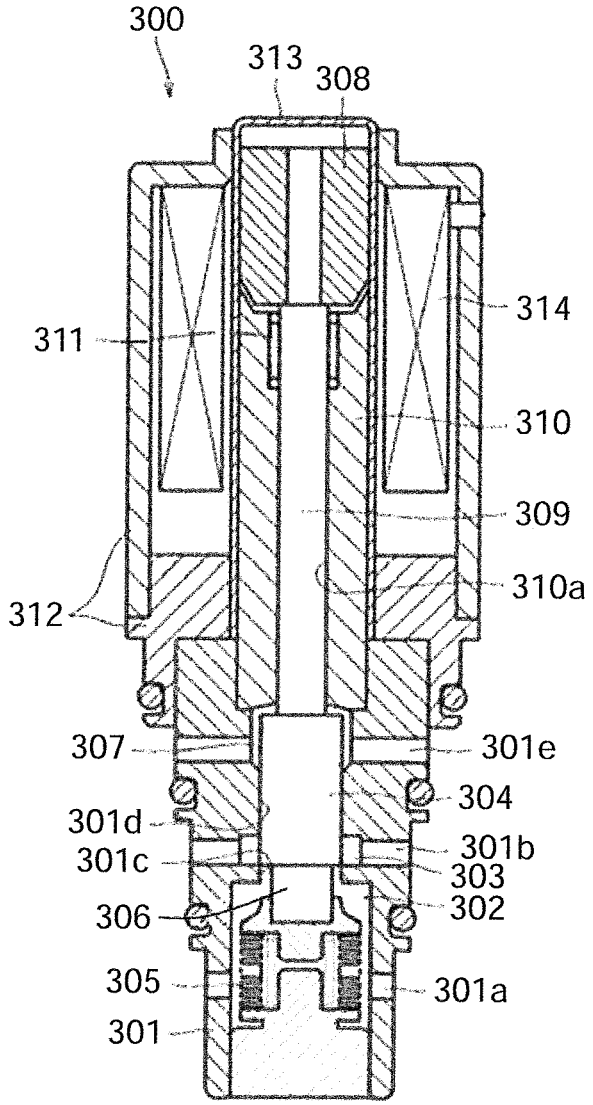
FIG. 2 is an entire cross-sectional view of a first control valve.

Next, the details of the first control valve 300 will be described with reference to FIG. 2 to FIG. 4.

The first control valve 300 is composed of: a valve unit; and a drive unit that opens and closes the valve unit.

The valve unit includes a cylindrical valve housing 301, and in an inside thereof, a first pressure sensing chamber 302 as a first pressure chamber, a valve chamber 303 partitioned from the first pressure sensing chamber 302, and a second pressure sensing chamber 307 as a second pressure chamber partitioned from the valve chamber 303 are formed in an axial direction in this order. The first pressure sensing chamber 302 communicates with the crank chamber 140 via communication hole 301*a* formed on an outer circumferential surface of the valve housing 301 and via the pressure supply passage 145. The second pressure sensing chamber 307 communicates with the suction chamber 141 via a communication hole 301*e* formed on the outer circumferential surface of the valve housing 301 and via the communication passage 104*c* (illustrated in FIG. 1). The valve chamber 303 communicates with the discharge chamber 142 via a communication hole 301*b* formed on the outer circumferential surface of the valve housing 301. The first pressure sensing chamber 302 and the valve chamber 303 are made communicable with each other via a valve hole 301*c* formed in an inside of the valve housing 301.

In the inside of the first pressure sensing chamber 302, a bellows 305 is disposed, which evacuates an inside thereof, incorporates a spring therein, and is deformable in the axial direction of the valve housing 301. This bellows 305 has a pressure sensing function to sense a pressure in the first pressure sensing chamber 302, that is, in the crank chamber 140 that communicates with the first pressure sensing chamber 302 via the pressure supply passage 145. Moreover, in the valve housing 301, a columnar valve body 304 is housed. The valve body 304 is slidably supported in a support hole 301*d* formed between the valve chamber 303 and the second pressure sensing chamber 307, and moves in the axial direction of the valve housing 301. One end of the valve body 304 serves as a first valve portion that opens and closes the valve hole 301*c* to open and close the pressure supply passage 145, and other end thereof serves as a second valve portion that is disposed in the second pressure sensing chamber 307 and opens and closes a pressure relief passage 320 to be described later. On the one end of the valve body 304, a small-diameter coupling portion 306 is formed integrally therewith. Such an end portion of the coupling portion 306 is disposed so as to be capable of abutting against the bellows 305, and the coupling portion 306 has a function to transmit the displacement of the bellows 305 to the valve body 304. Here, the above-described coupling portion 306 corresponds to an extended member extended from the first valve portion into the first pressure chamber.

The drive unit has a cylindrical solenoid housing 312 coupled to other end of the valve housing 301 coaxially therewith. In the solenoid housing 312, a molded coil 314 in which an electromagnetic coil is covered with resin is housed. Moreover, in the solenoid housing 312, a cylindrical fixed core 310 extended from the valve housing 301 to a center of the molded coil 314 is housed. The fixed core 310 has an insertion hole 310*a* in a center thereof, and a solenoid rod 309 is inserted into this insertion hole 310*a*. In the solenoid rod 309, one end side thereof is press-fitted and fixed into the valve body 304 coaxially therewith, and other end side thereof is fitted to a through hole formed in a movable core 308, and the solenoid rod 309 and the movable core 308 are integrated with each other.

Moreover, between the fixed core 310 and the movable core 308, there is provided a forced release spring 311 that urges the valve body 304 in an opening direction (an upper direction in the drawing) via the movable core 308 and the solenoid rod 309. Outer circumferences of the movable core 308 and the fixed core 310 and an upper side of the movable core 308 are covered with a cylindrical sleeve 313 formed of a stainless material as a non-magnetic material.

The movable core 308, the fixed core 310 and the solenoid housing 312 are formed of a magnetic material, and compose a magnetic circuit, and a control device (not illustrated) provided on an outside of the compressor 100 is connected to the molded coil 314. Hence, upon being supplied with a control current I from the control device, the molded coil 314 generates electromagnetic force F(I), the movable core 308 is attracted toward the fixed core 310 by the electromagnetic force F(I), and the valve body 304 moves in a valve closing direction (a lower direction in the drawing).

Force acting in opening and closing directions of the valve body 304 of the first control valve 300 is urging force f generated by the forced release spring 311, force generated by the pressure (a crank pressure Pc) in the first pressure sensing chamber 302, force generated by the pressure (a suction pressure Ps) of the second pressure sensing chamber 307, and urging force F generated by a spring incorporated in the bellows 305, as well as the electromagnetic force F(I) generated by the molded coil 314. A relationship among these is represented by the following Equation (1) since Sb, Sv and Sr are set equal to one another (Sb=Sv=Sr)where an effective pressure receiving area in a valve body opening direction of the bellows 305 is defined as Sb, a receiving area for a crank chamber 140-side pressure which the valve body 304 receives from the first pressure sensing chamber 302 side via the valve hole 301*c* is defined as Sv, and a receiving area for the suction chamber 141-side pressure that acts on the valve body 304 via the second pressure sensing chamber 307 is defined as Sr. Note that, in Equation 1, "+" indicates the valve closing direction of the valve body 304, and "−" indicates the valve opening direction thereof.

$$Ps=-(1/Sb)\cdot F(I)+(F+f)/Sb \quad (1)$$

Here, Ps is the pressure in the suction chamber 141, F(I) is the electromagnetic force, f is the urging force of the forced release spring 311, and F is the urging force of the bellows 305.

When the pressure in the suction chamber 141 becomes higher than a set pressure, then in order to increase a discharge displacement, a coupled body of the bellows 305, the coupling portion 306 and the valve body 304 controls the valve body 304 to the closing direction, and decreases the opening degree of the pressure supply passage 145 to decrease the pressure in the crank chamber 140. When the pressure in the suction chamber 141 falls down below the set pressure, then in order to decrease the discharge displacement, the coupled body controls the valve body 304 to the opening direction, and increases the opening degree of the pressure supply passage 145 to raise the pressure in the crank chamber 140. In this way, the coupled body autonomously controls the opening degree of the pressure supply passage 145 so that the pressure in the suction chamber 141 can approach the set pressure.

Figure 3:
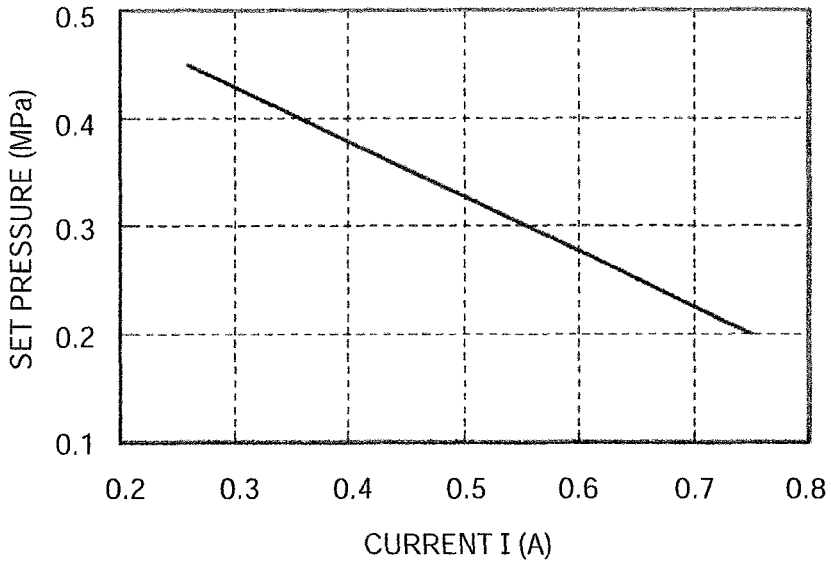
FIG. 3 is a control characteristic diagram illustrating a relationship between a set pressure and current value of the first control valve.

The electromagnetic force of the molded coil 314 acts on the valve body 304 via the solenoid rod 309 in the valve closing direction, and accordingly, when an energization amount to the molded coil 314 increases, the first control valve 300 operates so that the force in the direction of decreasing the opening degree of the pressure supply passage 145 can increase to decrease the set pressure as illustrated in FIG. 3. Note that the first control valve 300 is driven by pulse width modulation (PWM control) at a predetermined frequency in the range of, for example, 400 Hz to 500 Hz, and a pulse width (a duty ratio) is changed so that a value of a current flowing through the molded coil 314 can reach a desired value.

Moreover, as illustrated in FIG. 4, in the first control valve 300, there is formed a pressure relief passage 320, which causes the suction chamber 141 and a region of the pressure supply passage 145, which is located between the first control valve 300 and the check valve 250, to communicate with each other, and serves for relieving a refrigerant pressure in the region of the pressure supply passage 145, which is located between the first control valve 300 and the check valve 250, to the suction chamber 141 side. The pressure relief passage 320 is composed of: a communication hole 306*a*, which is formed on an outer circumferential surface of the coupling portion 306, and opens to the first pressure sensing chamber 302; a communication hole 304*a* that forms an internal space in an inside of the valve body 304 and the coupling portion 306, which are formed integrally with each other, the internal space communicating with the communication hole 306*a*; a spiral groove 309*a*, which is formed on an outer circumferential surface of a valve body press-fitting portion of the solenoid rod 309 in a press-fitting hole formed in the valve body 304, and communicates with the communication hole 304*a*; an other end-side end surface of the valve body 304, which communicates with this spiral groove 309*a*; the second pressure sensing chamber 307; the communication holes 301*e*; and the communication passage 104*c* (illustrated in FIG. 1). Here, the communication hole 306*a* formed on the outer circumferential surface of the coupling portion 306 corresponds to an opening portion formed in the extended member.

Moreover, an end surface 304*c* of the valve body 304, which is on the solenoid rod 309 side, has a recessed portion in an inside thereof, and the spiral groove 309*a* opens to the above-described recessed portion. Hence, when the end surface 304*c* of the valve body 304 abuts against an end surface of the fixed core 310, then the pressure relief passage 320 is closed, and the first pressure sensing chamber 302, which is the region of the pressure supply passage 145 between the first control valve 300 and the check valve 250, is shut off from the suction chamber 141. Meanwhile, when the end surface 304*c* of the valve body 304 separates from the end surface of the fixed core 310, then the pressure relief passage 320 opens, and the first pressure sensing chamber 302 communicates with the suction chamber 141 via the pressure relief passage 320. Here, the spiral groove 309*a* of the pressure relief passage 320 is formed so as to play a role of a throttle when the pressure relief passage 320 opens. Note that a linear groove may be used in place of the spiral groove 309*a*, or alternatively, a groove may be formed on an inner circumferential wall of the press-fitting hole for press-fitting an end portion of the solenoid rod 309, the press-fitting hole being formed not on the solenoid rod 309 side but on the valve body 304 side. Moreover, the groove can also be composed by being caused to communicate with the other end-side end surface by a hole provided in such an inside of the valve body press-fitting portion of the solenoid rod 309. By adopting the spiral groove, it becomes easy to manufacture the first control valve 300.

Figure 4A:
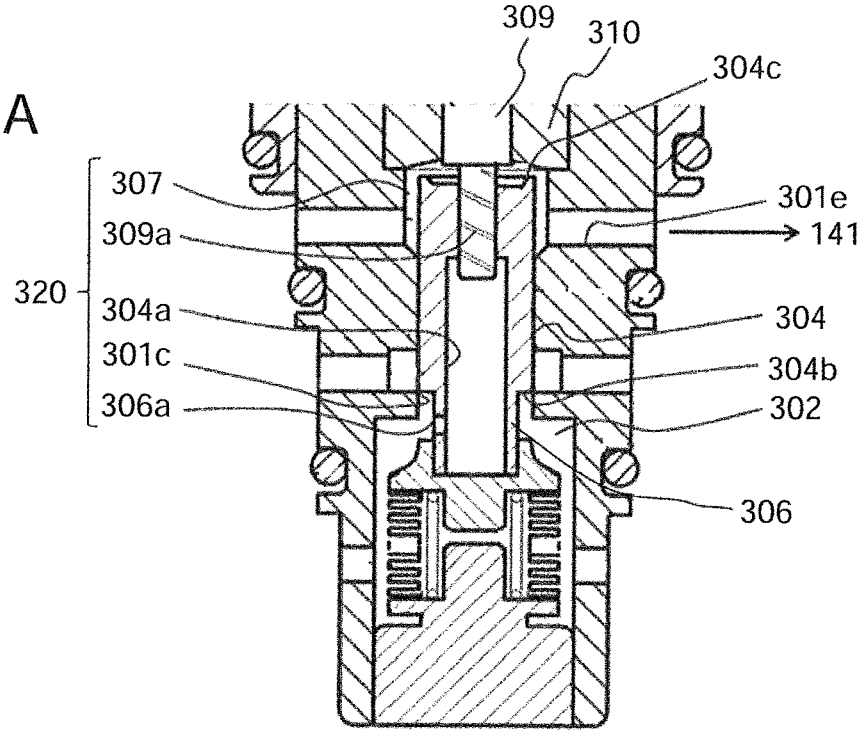
FIGS. 4A and 4B illustrate a pressure relief passage in an inside of the first control valve and an opening and closing structure thereof.
Figure 4B:
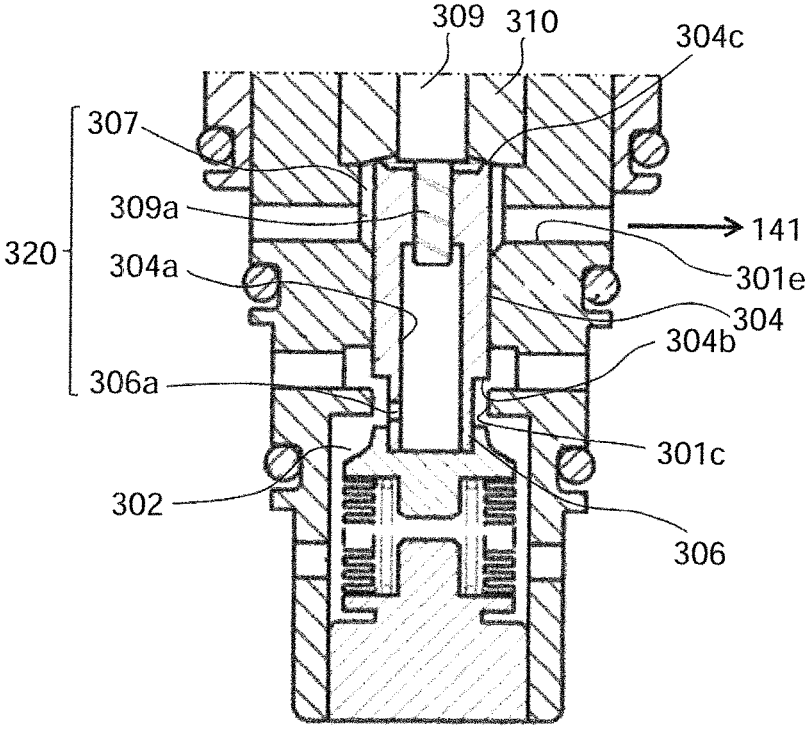

In the first control valve 300, when the molded coil 314 is demagnetized, an end surface 304*b* of the valve body 304 separates from such a circumference of the valve hole 301*c* by the urging force of the forced release spring 311, and a valve opening degree of the first control valve 300 is maximized, and at this time, as illustrated in FIG. 4B, the end surface 304*c* of the valve body 304 abuts against the end surface of the fixed core 310, and the pressure relief passage 320 is closed. Moreover, if a current with such a value that electromagnetic force exceeding the urging force of the forced release spring 311 acts is applied to the molded coil 314, then the valve body 304 of the first control valve 300 moves in the valve closing direction, then as illustrated in FIG. 4A, the end surface 304*c* of the valve body 304 separates from the end surface of the fixed core 310, and the pressure relief passage 320 is opened. Hence, the end surface 304*c* of the valve body 304 of the first control valve 300 and the fixed core 310 thereof compose opening and closing means capable of opening and closing the pressure relief passage 320, the pressure relief passage 320 is closed only when the variable displacement compressor 100 in which the first control valve 300 is demagnetized is in a non-operation state (OFF), and the pressure relief passage 320 turns to an open state when the variable displacement compressor 100 is in an operation state (ON) in which the first control valve 300 is magnetized, and plays a role as a throttle passage by the spiral groove 309*a*. Here, the end surface 304*c* of the valve body 304 corresponds to the second valve portion of the valve body 304, and the end surface of the fixed core 310, which the end surface 304*c* of the valve body 304 abuts against and separates from, corresponds to a restricting portion that, when the molded coil 314 is demagnetized, receives the abutment of the second valve portion (the end surface 304*c* of the valve body 304), restricts the movement of the valve body 304, and restricts a maximum opening degree of the first valve portion (the end surface 304*b* of the valve body 304) of the valve body 304.

Next, the details of the check valve 250 will be described with reference to FIG. 5.

The check valve 250 interposed in the pressure supply passage 145 downstream of the first control valve 300 is composed of: a valve body 251 slidably supported on a housing hole 101*e* having a small-diameter portion 101*e*1 and a large-diameter portion 101*e*2, which are formed on an end surface of the cylinder block 101 on the valve plate 103 side; and the above-mentioned suction valve forming plate 150 that closes one end of the housing hole 101*e*. The valve body 251 is formed of a cylindrical body composed of a small-diameter portion 251*a*1 and a large-diameter portion 251*a*2, in which the small-diameter portion 251*a*1 side is closed by an end surface 251*b*. In the valve body 251, a communication hole 251*c* is formed on a side wall of the small-diameter portion 251*a*1. Note that the valve body 251 is formed of, for example, a resin material; however, may be formed of other material such as a metal material.

A space between the small-diameter portion 251*a*1 of the valve body 251 and the large-diameter portion 101*e*2 of the housing hole 101*e* forms an annular passage, and communicates with an internal passage 252, which is formed in the valve body 251, via a communication hole 251*c*. With regard to the valve body 251, movement of one end thereof is restricted in such a manner that an end surface 251*b* thereof abuts against the suction valve forming plate 150, and movement of other end thereof is restricted in such a manner that an end portion of the valve body 251 on the large-diameter portion 251*a*2 side abuts against an end surface 101*e*3 of the housing hole.

The large-diameter portion 101*e*2 side of the housing hole 101*e* communicates with the cylinder head 104-side pressure supply passage 145 via a valve hole 150*a* formed in the suction valve forming plate 150. Moreover, the small-diameter portion 101*e*1 side of the housing hole 101*e* communicates with the crank chamber 140 via the cylinder block 101-side pressure supply passage 145.

Hence, on the valve body 251, there act a pressure Pm in the pressure supply passage 145 on the upstream cylinder head 104 side and a pressure Pc in the downstream crank chamber 140, and the valve body 251 moves in response to a pressure difference (Pm−Pc) between such an upstream pressure Pm and such a downstream pressure Pc.

Operations of the check valve 250 will be described.

Figure 5A:
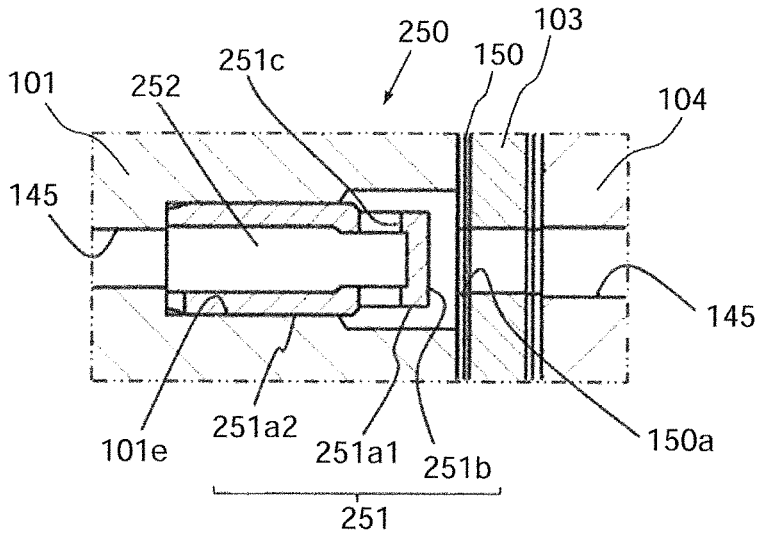
FIGS. 5A and 5B illustrate a check valve.
Figure 5B:
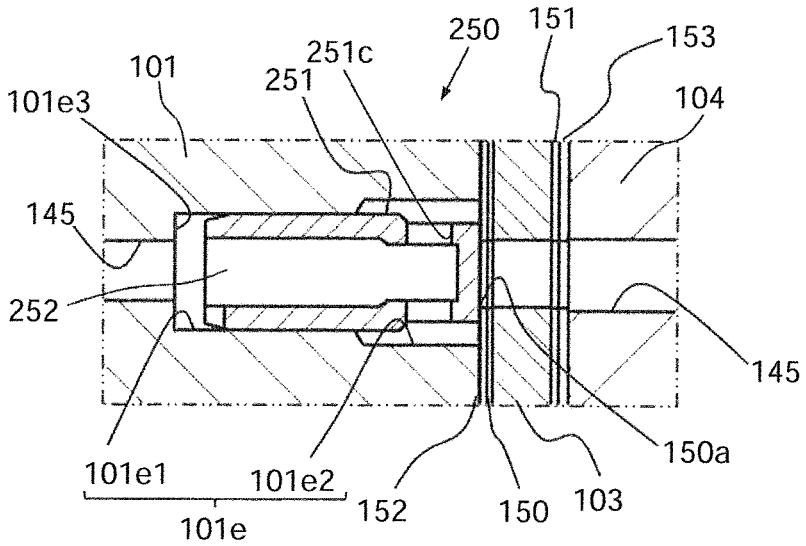

In a state in which the first control valve 300 is open, the compressed refrigerant from the discharge chamber 142 reaches the check valve 250 via the pressure supply passage 145 located downstream of the first control valve 300, and raises the pressure Pm acting on the valve body 251. Accordingly, Pm−Pc>0 is established, and as illustrated in FIG. 5A, the valve body 251 moves to a left side in the drawing, and turns to a valve open state. In this way, the compressed refrigerant in the discharge chamber 142 passes through the internal passage 252 of the check valve 250, and is supplied to the crank chamber 140. When the first control valve 300 turns from such an open state to a closed state, the compressed refrigerant in the discharge chamber 142 is not supplied to the pressure supply passage 145 located downstream of the first control valve 300. At this time, the region of the pressure supply passage 145, which is located between the first control valve 300 and the check valve 250, communicates with the suction chamber 141 via the pressure relief passage 320 in the first control valve 300, and the refrigerant gas in the region of the pressure supply passage 145 between the first control valve 300 and the check valve 250 flows to the suction chamber 141 via the pressure relief passage 320. In this way, the upstream side pressure Pm decreases, and Pm−Pc<0 is established, and as illustrated in FIG. 5B, the valve body 251 moves to a right side in the drawing. Then, the end surface 251*b* of the valve body 251 abuts against the suction valve forming plate 150, and closes the valve hole 150*a*, and brings a closed state of the valve. In this way, the pressure supply passage 145 is shut off, and the pressure in the region of the pressure supply passage 145 between the first control valve 300 and the check valve 250 becomes a pressure equivalent to that of the suction chamber 141 with which the region concerned communicates via the pressure relief passage 320. That is, the check valve 250 is configured to open and close the pressure supply passage 145 in conjunction with opening and closing operations of the first control valve 300.

Note that the check valve 250 may be configured to be added with urging means such as a compression coil spring that urges the valve body 251 toward the valve plate 103. Moreover, in place of the suction valve forming plate 150, for example, the valve plate 103 may be used as the valve seat against which the end surface 251*b* of the valve body 251 abuts.

Next, the details of the second control valve 350 will be described with reference to FIG. 6.

The second control valve 350 includes: a housing chamber 104*e*, which is formed on an open end surface 104*d* side of the cylinder head 104, and is composed of a small-diameter first housing chamber 104*e*1 and a large-diameter second housing chamber 104*e*2; a partition member 351 that partitions the housing chamber 104*e* into the small-diameter first housing chamber 104*e*1 and the large-diameter second housing chamber 104*e*2; the discharge valve forming plate 151, which closes an open end surface side of the housing chamber 104*e*, and has a valve hole 151*a* formed therein; the spool 352 movably disposed in the housing chamber 104*e*.

Note that, as the member that closes the housing chamber 104*e*, in place of the discharge valve forming plate 151, there may be used other compression constituent member placed between the cylinder block 101 and the cylinder head 104, or alternatively, a new dedicated member may be added. If any one of the suction valve forming plate 150, the discharge valve forming plate 151 and the valve plate 103 is used as the closing member, then it is not necessary to newly add such a dedicated closing member, moreover, good accuracy of flatness is brought, and accordingly, any one thereof is suitable as the closing member that plays a role of the valve seat.

In a circumferential wall of the second housing chamber 104*e*2 of the housing chamber 104*e*, a communication passage 104*g* is formed, which communicates with the second housing chamber 104*e*2 and the suction chamber 141. Moreover, the first housing chamber 104*e*1 of the housing chamber 104*e* communicates with the housing hole 104*b*, which is located downstream of the first control valve 300, via a communication passage 104*f*. Hence, the first housing chamber 104*e*1 forms a back pressure chamber of the second control valve 350. Moreover, the second housing chamber 104*e*2 of the housing chamber 104*e* communicates with the crank chamber 140 via the valve hole 151*a* of the discharge valve forming plate 151, the respective communication holes formed in the valve plate 103 and the suction valve forming plate 150, the space portion 101*d*, and the communication passage 101*c*, and moreover, communicates with the suction chamber 141 via the communication passage 104*g*. Hence, the communication passage 101*c*, the space portion 101*d*, the respective communication holes of the suction valve forming plate 150 and the valve plate 103, the valve hole 151*a*, the second housing chamber 104*e*2, and the communication passage 104*g* compose the second pressure release passage 146*b* that causes the crank chamber 140 and the suction chamber 141 to communicate with each other.

The partition member 351 is formed of a cylindrical member, which is composed of a side wall and a closed-side end portion 351*b*, and has one end closed. The partition member 351 is positioned in and press-fitted into the second housing chamber 104*e*2 so that an open-side end surface 351*a* thereof can abut against the discharge valve forming plate 151. Moreover, the partition member 351 partitions the second housing chamber 104*e*2 into an inner cylindrical space, which serves as a valve chamber 351*c*, and an outer annular space, and by a closed-side end portion 351*b* thereof, partitions the first housing chamber 104*e*1 and the valve chamber 351*c* from each other. In a center portion of the closed-side end portion 351*b* of the partition member 351, a through hole 351*b*1 is formed. In the side wall of the partition member 351, a communication hole 351*a*1 is formed, which causes the valve chamber 351*c* and an annular space in the second housing chamber 104*e*2 on an outside thereof to communicate with each other.

The spool 352 includes: a pressure receiving portion 352*a*, which is housed in the first housing chamber 104*e*1 so that one end surface 352*a*1 thereof can be capable of abutting against and separating from an end wall 104*e*3 of the first housing chamber 104*e*1; a valve portion 352*b* housed in the valve chamber 351*c*, in which one end surface 352*b*1 abuts against and separates from the discharge valve forming plate 151 to open and close the valve hole 151*a*; and a shaft portion 352*c* that couples the pressure receiving portion 352*a* and the valve portion 352*b* to each other. Then, the spool 352 is formed in such a manner that the pressure receiving portion 352*a* is press-fitted into the shaft portion 352*c* in a state in which the shaft portion 352*c* formed integrally with the valve portion 352*b* is inserted into a through hole 351*b*1 of the partition member 351. Note that such a press-fitted position of the pressure receiving portion 352*a* with respect to the valve portion 352*b* is adjusted so that, when one end surface 352*b*1 of the valve portion 352*b* abuts against the discharge valve forming plate 151, other end surface 352*a*2 of the pressure receiving portion 352*a* can simultaneously abut against an outer surface of the closed-side end portion 351*b* of the partition member 351.

Figure 6A:
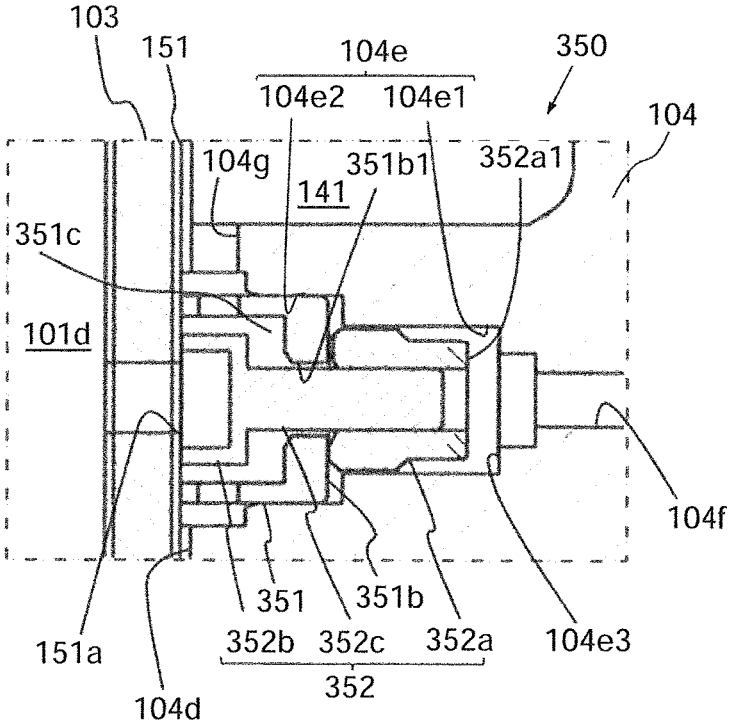
FIGS. 6A and 6B illustrate a second control valve.
Figure 6B:
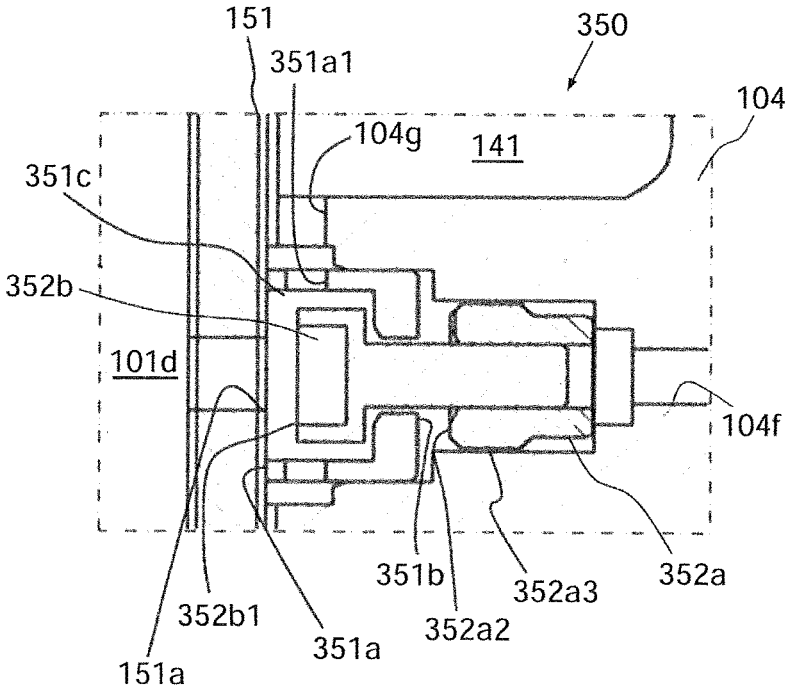

The spool 352 of the second control valve 350 receives a pressure of the pressure supply passage 145 between the first control valve 300 and the check valve 250, that is, the so-called back pressure Pm on one end surface (an end surface on the pressure receiving portion 352*a* side) thereof, receives the pressure Pc in the crank chamber 140 on other end surface (an end surface on the valve portion 352*b* side), and moves in response to the pressure difference (Pm−Pc) therebetween. Hence, when Pm−Pc>0 is established, then as illustrated in FIG. 6A, the one end surface 352*b*1 of the valve portion 352*b* abuts against the discharge valve forming plate 151 to close the valve hole 151*a*, whereby the spool 352 closes the second pressure release passage 146*b*. Meanwhile, Pm−Pc<0 is established, then as illustrated in FIG. 6B, the one end surface 352*a*1 of the pressure receiving portion 352*a* abuts against the end wall 104*e*3 to open the valve hole 151*a*, whereby the spool 352 opens the second pressure release passage 146*b* to the maximum. Note that a pressure receiving area S1 of the spool 352 that receives the back pressure Pm and a pressure receiving area S2 of the spool 352 that receives the pressure Pc in the crank chamber 140 are set, for example, to S1=S2; however, S1 and S2 may be set to S1>S2 or S1<S2 in order to adjust operations of the spool 352.

Operations of the second control valve 350 will be described.

The second control valve 350 opens and closes in conjunction with the opening and closing of the first control valve 300, and when the first control valve 300 is closed, the pressure relief passage 320 opens to decrease the back pressure Pm, whereby the second control valve 350 opens upon receiving the refrigerant pressure on the crank chamber 140 side, and opens the second pressure release passage 146*b*. In this way, the pressure release passage 146 is composed of the first pressure release passage 146*a* and the second pressure release passage 146*b*, and the flow passage cross-sectional area of the pressure release passage 146 is increased. Meanwhile, when the first control valve 300 is demagnetized and in a full open state, the pressure relief passage 320 is closed to increase the back pressure Pm, whereby the second control valve 350 is closed upon receiving the refrigerant pressure on the downstream side of the first control valve 300, and closes the second pressure release passage 146*b*. In this way, the pressure release passage 146 is composed of only the first pressure release passage 146*a*, and the flow passage cross-sectional area of the pressure release passage 146 is reduced.

Moreover, in the second control valve 350, a minute gap is formed between an outermost circumferential surface 352*a*3 of the pressure receiving portion 352*a*, which is slidably supported on an inner circumferential surface of the first housing chamber 104*e*1, and the inner circumferential surface of the first housing chamber 104*e*1. Therefore, in a state in which the one end surface 352*a*1 of the pressure receiving portion 352*a* slightly separates from the end wall 104*e*3 (that is, in the open state of the second control valve 350), the refrigerant gas, which has flown into the first housing chamber 104*e*1 from the communication passage 104*f*, is adapted to flow into the valve chamber 351*c* via a gap between the outermost circumferential surface 352*a*3 of the pressure receiving portion 352*a* and the inner circumferential surface of the first housing chamber 104*e*1 and a gap between the outer circumferential surface of the shaft portion 352*c* and the inner circumferential surface of the through hole 351*b*1. However, the second control valve 350 is configured so that, when the valve portion 352*b* abuts against the discharge valve forming plate 151 (that is, in the closed state of the second control valve 350), the other end surface 352*a*2 of the pressure receiving portion 352*a* can abut against the outer surface of the closed-side end portion 351*b* of the partition member 351. Accordingly, the flow of the refrigerant from the first housing chamber 104*e*1 to the valve chamber 351*c*, the flow passing via the gap between the outer circumferential surface of the shaft portion 352*c* and the inner circumferential surface of the through hole 351*b*1, is blocked. That is, when the second control valve 350 is in such a closed state in which the valve portion 352*b* abuts against the discharge valve forming plate 151, a steady flow of the refrigerant does not occur in the first housing chamber 104*e*1.

Next, operations of the variable displacement compressor 100 of this embodiment will be described.

When the air conditioning system is in operation, that is, in a state in which the variable displacement compressor 100 is operated, the energization amount to the molded coil 314 is adjusted based on air conditioning setting and an external environment, and the discharge displacement is controlled so that the pressure of the suction chamber 141 can become the set pressure corresponding to the energization amount. When the energization to the molded coil 314 of the first control valve 300 is interrupted from such a state in which the variable displacement compressor 100 is operated, then the first control valve 300 is fully opened. In this way, the pressure in the region of the pressure supply passage 145 between the first control valve 300 and the check valve 250, that is, the back pressure Pm acting on the second control valve 350 rises, and accordingly, the second control valve 350 closes the second pressure release passage 146*b*. Hence, the pressure release passage 146 becomes only the first pressure release passage 146*a*, the pressure in the crank chamber 140 rises, the inclination angle of the swash plate 111 decreases, and the discharge displacement turns to the minimum state (a minimum discharge displacement operation state). Moreover, substantially simultaneously, the check valve 200 shuts off the discharge passage due to the decrease of the discharge displacement, and the refrigerant gas delivered with the minimum discharge displacement does not flow to an external refrigerant circuit, and circulates through an internal circulation passage composed of the discharge chamber 142, the pressure supply passage 145, the crank chamber 140, the pressure release passage 146*a*, the suction chamber 141 and the cylinder bore 101*a*.

Then, in the minimum discharge displacement operation state in which the first control valve 300 is fully opened, the end surface 304*c* of the valve body 304 of the first control valve 300 abuts against the fixed core 310, and the pressure relief passage 320 is closed. Hence, the refrigerant gas delivered from the discharge chamber 142 is entirely supplied to the crank chamber 140 via the pressure supply passage 145, circulates through the internal circulation passage, and lubricates the respective portions of the variable displacement compressor 100.

When the molded coil 314 of the first control valve 300 is energized from this state, then the first control valve 300 closed to close the pressure supply passage 145, and at the same time, the solenoid rod 309-side end surface 304*c* of the valve body 304 of the first control valve 300 separates from the fixed core 310, and the pressure relief passage 320 is opened. In this way, the refrigerant gas in the region of the pressure supply passage 145 between the first control valve 300 and the check valve 250 flows out into the suction chamber 141 via the pressure relief passage 320. Then, the pressure in the region of the pressure supply passage 145 between the first control valve 300 and the check valve 250 decreases, and then the check valve 250 closes the pressure supply passage 145, whereby the refrigerant gas is hindered from flowing backward from the crank chamber 140 to the pressure supply passage 145, which is located upstream of the check valve 250, via the pressure supply passage 145 that communicates with the crank chamber 140 on the downstream side of the check valve 250. Moreover, the second pressure release passage 146*b* opens due to the decrease in the back pressure Pm acting on the second control valve 350, and the pressure release passage 146 is composed of two pressure release passages, which are the first pressure release passage 146*a* and the second pressure release passage 146*b*.

A flow passage cross-sectional area of the second control valve 350 is set larger than a flow passage cross-sectional area of the fixed throttle 103*c*, and accordingly, the refrigerant in the crank chamber 140 quickly flows out into the suction chamber 141, the pressure in the crank chamber 140 decreases, and the discharge displacement quickly increases from the state of the minimum to the maximum discharge displacement. In this way, the discharge pressure of the discharge chamber 142 rises suddenly to open the check valve 200, the refrigerant circulates through the external refrigerant circuit, and the air conditioning system turns to an operation state.

When the air conditioning system operates, and the pressure in the suction chamber 141 decreases and reaches the set pressure set by the current supplied to the molded coil 314, then the first control valve 300 opens. In this way, the pressure downstream of the first control valve 300 rises, the check valve 250 opens the pressure supply passage 145, and the second control valve 350 closes the second pressure release passage 146*b* due to the pressure rise of the back pressure Pm acting on the second control valve 350. Hence, the pressure release passage 146 becomes only the first pressure release passage 146*a*. Therefore, the refrigerant in the crank chamber 140 is restricted from flowing into the suction chamber 141, the pressure in the crank chamber 140 becomes easy to rise, the opening degree of the first control valve 300 is autonomously adjusted so that the pressure in the suction chamber 141 can maintain the set pressure, and the discharge displacement is variably controlled.

According to the variable displacement compressor 100 with such a configuration, most of the compressed refrigerant delivered from the discharge chamber 142 in the minimum discharge displacement operation state can be supplied to the crank chamber 140. Hence, the pressure in the crank chamber 140 can be sufficiently increased, a load on the compressor at the time of the minimum discharge displacement operation can be reduced. Moreover, an amount of the lubricating oil in the crank chamber 140 can also be ensured sufficiently, and the insufficient lubrication of the sliding portions and the like in the crank chamber 140 can be prevented.

Note that, in this embodiment, the pressure relief passage and such opening and closing means for the pressure relief passage are composed integrally in the inside of the first control valve; however, the pressure relief passage and the opening and closing means may be provided separately from the first control valve.

Moreover, in this embodiment, the first control valve 300 adjusts the opening degree of the pressure supply passage so that the pressure in the suction chamber can become the set pressure; however, may be a control valve configured so that the pressure in the crank chamber and the pressure in the discharge chamber can act thereon, or alternatively, may be an electromagnetic control valve that does not have the pressure sensing member such as the bellows.

Moreover, in this embodiment, the second control valve is configured to close the second pressure release passage when one end surface of the valve portion of the spool abuts against the discharge valve forming plate; however, may be configured not to completely close the second pressure release passage, but to cause the refrigerant to flow into the suction chamber from the crank chamber via a groove (a throttle) even if the groove (the throttle) described above is formed on the end surface of the valve portion and one end surface of the valve portion abuts against the discharge valve forming plate.

Furthermore, in this embodiment, a configuration is adopted, in which, when the second control valve closes the second pressure release passage, the pressure receiving portion of the spool abuts against the partition member, and the flow of the refrigerant from the first housing chamber 104*e*1 to the valve chamber 351*c* is cut off; however, a structure that allows slight leakage of the refrigerant may be adopted.

Moreover, in this embodiment, a configuration in which the second control valve is disposed in the cylinder head is adopted; however, the second control valve may be disposed in other housing constituent members, for example, the cylinder block. Furthermore, the second control valve may be housed in a dedicated housing, and may be disposed in the compressor housing.

Moreover, in this embodiment, a configuration in which the check valve 250 is disposed in the cylinder block is adopted; however, the check valve 250 may be disposed in the cylinder head.

Moreover, in this embodiment, the compressor is defined to be such a clutchless variable displacement compressor of the swash plate type; however, the present invention is not limited to this. The compressor may be a variable displacement compressor equipped with an electromagnetic clutch, or a variable displacement compressor driven by a motor.

REFERENCE SYMBOL LIST

100 variable displacement compressor
140 crank chamber
141 suction chamber
142 discharge chamber
145 pressure supply passage
146 pressure release passage
146*a* first pressure release passage
146*b* second pressure release passage
250 check valve
300 first control valve
304 valve body
304*a* communication hole
306 coupling portion
306*a* communication hole
307 second pressure sensing chamber
308 movable core
309 solenoid rod

309*a* spiral groove
310 fixed core
314 molded coil
320 pressure relief passage
350 second control valve

The invention claimed is:

1. A variable displacement compressor, which includes:

a first control valve that controls an opening degree of a pressure supply passage that causes a discharge chamber and a crank chamber to communicate with each other;

a check valve that is interposed in the pressure supply passage downstream of the first control valve, and blocks a flow of a refrigerant from a crank chamber side to a first control valve side;

a second control valve that controls an opening degree of a pressure release passage that releases a refrigerant pressure in the crank chamber to a suction chamber side in conjunction with the first control valve, receives a refrigerant pressure in a pressure supply passage region downstream of the first control valve and decreases the opening degree of the pressure release passage when the first control valve opens, and receives a refrigerant pressure on the crank chamber side and increases the opening degree of the pressure release passage when the first control valve closes; and a pressure relief passage that relieves a refrigerant pressure in a pressure supply passage region between the first control valve and the check valve to the suction chamber side, in which the variable displacement compressor controls an opening degree of the first control valve to control the refrigerant pressure in the crank chamber, and changes an inclination angle of a swash plate in the crank chamber to vary a discharge displacement, wherein an opening and closing means capable of opening and closing the pressure relief passage is provided.

2. The variable displacement compressor according to claim 1, wherein the opening and closing means is configured to operate in conjunction with opening and closing operations of the first control valve, to close the pressure relief passage when the first control valve opens, and to open the pressure relief passage when the first control valve closes.

3. The variable displacement compressor according to claim 2, wherein the pressure relief passage is configured to relieve the refrigerant pressure in the pressure supply passage region between the first control valve and the check valve to the suction chamber side via an inside of the first control valve, and the opening and closing means is composed integrally with the first control valve and is configured to open and close a pressure relief passage portion in an inside of the first control valve.

4. The variable displacement compressor according to claim 3, wherein the first control valve is an electromagnetic control valve that closes to close the pressure supply passage when an electromagnetic coil is magnetized, and opens to open the pressure supply passage when the electromagnetic coil is demagnetized, and the opening and closing means is configured to open the pressure relief passage when the electromagnetic coil of the first control valve is magnetized, and to close the pressure relief passage when the electromagnetic coil of the first control valve is demagnetized.

5. The variable displacement compressor according to claim 4, wherein the first control valve includes: a valve body that has, on one end side thereof, a first valve portion opening and closing the pressure supply passage, and on other end side thereof, a second valve portion opening and closing the pressure relief passage, and is movably supported in the first control valve; and a restricting portion that, when the electromagnetic coil is demagnetized, receives abutment of the second valve portion, restricts movement of the valve body, and restricts a maximum opening degree of the first valve portion, and the variable displacement compressor has a configuration in which the opening and closing means is composed of the second valve portion of the valve body and the restricting portion, and the pressure relief passage is opened and closed by causing the second valve portion to abut against and separate from the restricting portion.

6. The variable displacement compressor according to claim 5, wherein the first control valve includes: a valve chamber that has the first valve portion disposed therein and communicates with the discharge chamber; a first pressure chamber that is partitioned from the valve chamber and communicates with the crank chamber; a second pressure chamber that is partitioned from the valve chamber, has the second valve portion disposed therein, and communicates with the suction chamber; and an extended member that is extended from the first valve portion into the first pressure chamber and has an opening portion open to the first pressure chamber, and the pressure relief passage is configured to cause the suction chamber and a region of the pressure supply passage, the region being located between the first control valve and the check valve, to communicate with each other, via the first pressure chamber, the opening portion of the extended member, respective internal spaces of the extended member communicating with the opening portion and the valve body, a communication passage that causes the internal space of the valve body and the second pressure chamber to communicate with each other via the second valve portion, and the second pressure chamber.

7. The variable displacement compressor according to claim 6, wherein the valve body has a configuration in which other end of a solenoid rod in which one end thereof is coupled to one end of a movable core that moves by electromagnetic force generated by the electromagnetic coil is press-fitted from an end surface side of the second valve portion into the internal space of the valve body via a press-fitting hole formed in the valve body, and enables the valve body to move integrally with the solenoid rod, and the valve body has a configuration in which a groove portion is formed on either one of an outer circumferential surface of the other end of the solenoid rod and an inner circumferential surface of the press-fittting hole, and the groove portion is used as the communication passage.

* * * * *